United States Patent [19]

Kane et al.

[11] Patent Number: 5,032,834

[45] Date of Patent: Jul. 16, 1991

[54] STATUS DISPLAY SYSTEM

[75] Inventors: Michael S. Kane; David L. Kane, both of Cedar Park, Tex.

[73] Assignee: Sara E. Kane, Austin, Tex.

[21] Appl. No.: 478,535

[22] Filed: Feb. 12, 1990

[51] Int. Cl.[5] ..... G08B 5/36; G08B 5/00

[52] U.S. Cl. ..... 340/825.28; 340/826.01; 340/332

[58] Field of Search ..... 340/286.01, 286.02, 340/286.03, 330, 332, 825.28, 700, 707, 752, 754; 186/38, 39

[56] References Cited

U.S. PATENT DOCUMENTS

| | | | |
|---|---|---|---|
| 1,257,873 | 2/1918 | Johnson . | |
| 2,421,774 | 6/1947 | Colt et al. | 340/825.28 |
| 2,453,838 | 11/1948 | Fletcher et al. | 340/825.28 |
| 2,572,521 | 10/1951 | Rogers | 155/188 |
| 2,980,890 | 4/1961 | Staten | 340/825.28 |
| 3,228,020 | 1/1966 | Gassenheimer et al. | 340/332 |
| 3,618,078 | 11/1971 | Wittman et al. | 340/381 |
| 3,797,009 | 3/1974 | Crudgington et al. | 340/332 |
| 3,913,088 | 10/1975 | Sears | 340/332 |
| 3,961,435 | 6/1976 | Keckler | 40/130 |
| 4,935,720 | 6/1990 | Kalfoun | 340/332 |

*Primary Examiner*—Donald J. Yusko
*Assistant Examiner*—John Giust
*Attorney, Agent, or Firm*—Walter C. Farley

[57] ABSTRACT

A display and communication system includes display panels located at several locations which are separated from each other. Each panel has a matrix of plug-in modules and each module has lights and a switch device which can be operated to change which light on that module is illuminated, thereby indicating the status of a physical location, such as a table in a restaurant. The plug-in modules can be arranged on all of the panels to resemble the arrangement of the physical locations which are being represented. When the switch is operated to change the illumination of a light in a module, this change is communicated to all other panels, causing the counterpart modules in the other panels to exhibit the same illumination scheme.

5 Claims, 8 Drawing Sheets

STATUS DISPLAY SYSTEM

This invention relates to a system having a number of status display panels at any of which information about the status of locations can be entered and is displayed and wherein all of the panels are updated when the information is changed at any panel.

BACKGROUND OF THE INVENTION

In many enterprises where it is important to keep track of the locations of customers, this function is performed using written or printed articles, i.e., charts, lasts, files of cards or the like. In circumstances where this function has been computerized, the computer generally does little more than mimic an earlier technique, the only significant difference being that the user views the information on a monitor and manipulates it with a keyboard. Examples of businesses which must deal with this general problem are hotels, motels, restaurants and parking facilities. In each of these cases, it is necessary for someone to keep a continuing tally of which spaces (tables, rooms or parking slots) are available and which are committed or occupied.

The prior art includes some devices which are intended to keep track of "location occupied" information automatically. An example of this are systems in a theater including switches in each seat controlling lights at the box office to inform the ticket seller which seats are occupied. In addition to being impractical for various reasons (including the fact that a "sold" theater seat is not necessarily physically occupied until the show starts), there are other considerations such as the maintenance of the system and the large numbers of wires and the like. Systems of that type also have severe limitations and simply are not usable in a hotel or restaurant situation.

It has therefore been deemed more practical to employ the simpler approach of using charts or lists, whether manual or computerized. In many restaurant circumstances, no record at all is kept because of the difficulty of continually changing a written chart. The result is that the only record is in the memory of the person controlling the seating and visual observation of the facility is used to update this information. In a large restaurant where more than one host or hostess is seating patrons from more than one entrance, availability of seats may be controlled by allocating different sections for seating by different hosts or simply using a visual assessment approach, neither of which is entirely satisfactory.

SUMMARY OF THE INVENTION

An object of the present invention is to provide a system which provides display panels on which the status of a plurality of locations can be displayed and from any of which panels new status information can be entered which is then displayed on all other panels.

A further object is to provide such a system in which the panels are interconnected by a small number of wires.

Yet another object is to provide such a system in which the status information is presented by lights on plug-in modules and wherein the arrangement of the modules is flexible to allow the arrangement of lights to approximate the physical arrangement of the locations being monitored.

Briefly described, the invention comprises an information and display system including a plurality of frames each having a plurality of sockets for receiving display modules, each socket including a plurality of electrical contacts. A plurality of display modules are provided for each frame, each display module including a body with pin means on the body insertable into one of the sockets for supporting the body and making electrical connection with the contact means in the sockets. At least two display lights are carried by each body in a position to be visible when the module is supported on the frame. A manually operable switch means is carried by said body for producing a change signal. A control unit includes means for receiving change signals and for producing energizing signals for selectively energizing at least one of the display lights in a display module in each frame and circuit means electrically connect the control unit to each display module in each frame of the plurality of frames.

In a preferred form of the invention, each of the switch means is a phototransistor having an exposed photoresponsive portion, each phototransistor being operable by directing light from a manually movable light source, such as a light pen, toward the photoresponsive portion to produce a change signal.

BRIEF DESCRIPTION OF THE DRAWINGS

In order to impart full understanding of the manner in which these and other objects are attained in accordance with the invention, particularly advantageous embodiments thereof will be described with reference to the accompanying drawings, which form a part of this specification, and wherein:

FIG. 4 is a plan view of the socket region of a display panel of the system of FIG. 1 showing the socket arrangement with no display modules plugged in;

DETAILED DESCRIPTION OF A PREFERRED EMBODIMENT

Figure 1:
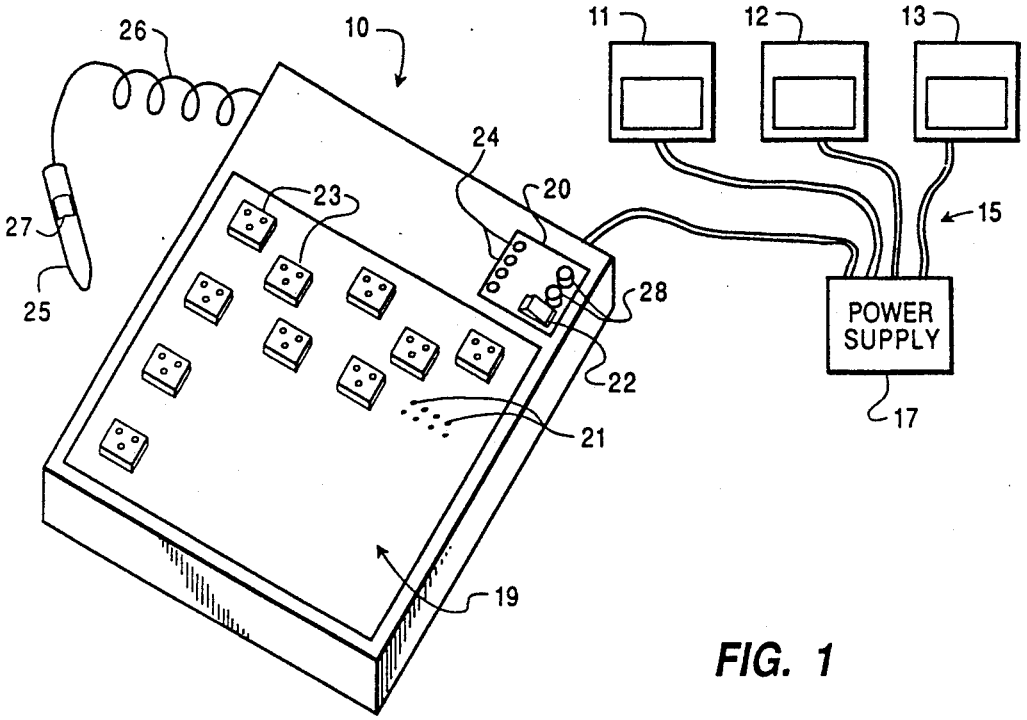
FIG. 1 is a schematic diagram of a system in accordance with the invention showing one display panel in a perspective view and the remaining components in block representations.

Referring first to FIG. 1, a system in accordance with the present invention includes a plurality of display panels 10, 11, 12 and 13. These panels are substantially identical to each other and so only panel 10 is illustrated in detail and will be fully described. Substantially any number of display panels can be interconnected in a system. In fact, it would be possible to have a system which only uses one panel but a one-panel system would be rather pointless because it would not take advantage of the highly desirable communication features of the invention. A multiconductor cable 15 interconnects these panels with each other and with a power supply unit 17 as shown in more detail in FIG. 7. Unit 17 can, of course, be physically incorporated into one of the panel structures as a matter of housing convenience but is shown as a separate entity to emphasize the fact that one power supply cooperates with all of the display panels in any one system.

Panel 10 includes a central region indicated generally at 19 which has a plurality of sockets 21 each of which is dimensioned to receive a pin for electrical connection of a display module 23. Each socket not only physically receives the module pins but also makes an electrical connection thereto. Thus, each socket contains conventional conductive members to receive and engage a pin and means to which wires can be connected. These wires lead to a controller board within the panel housing, not illustrated in FIG. 1, which is connected to cable 15.

The sockets 21 are arranged in specific patterns to receive the module pins in any of a number of possible positions, as will be described in greater detail with reference to FIGS. 4 and 5A–5D. A plurality of display modules 23 are shown in FIG. 1 in their plugged-in positions in the panel. A light source such as a light pen 25 is attached to the panel by a power cord 26, the light pen having a power switch 27 which can be depressed to activate the light source, such as a light-emitting diode (LED), for operation with the modules, as will be described.

Display panel 10 can also incorporate a control panel 20 having a power switch 22 and a plurality of indicator lights 24 which can be used for such purposes as showing when the system is on, providing an error indication and for other signaling purposes, if desired, between display panel locations. The control panel can also include control buttons 28 for issuing specific control commands such as an "update all panels" command or a "display error" command which will be described.

Figure 2:
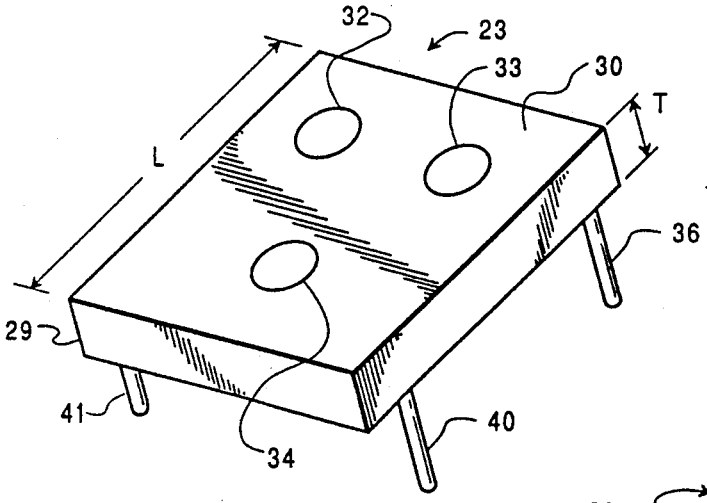
FIG. 2 is a perspective view of a display module usable in a display panel of the system of FIG. 1.
Figure 3:
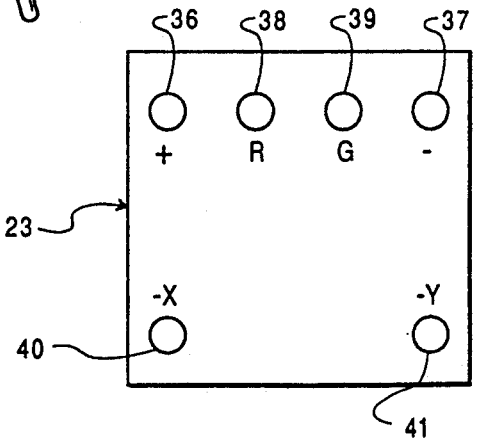
FIG. 3 is a rear plan view of the display module of FIG. 2 showing the pin arrangement thereon.

A display module 23 is shown in enlarged form in FIGS. 2 and 3. The module includes a generally parallelipipedal body 29 with a front face 30 having three openings or translucent lenses 32, 33 and 34. Within the body and behind openings 32 and 33 are red and green LEDs, respectively, and behind or in opening 34 is a light-responsive portion of a phototransistor. A plurality of electrically conductive pins 36, 37, 38, 39, 40 and 41 protrude from the back of each module, these pins being arranged nonsymmetrically such that the module cannot be plugged into the sockets in an incorrect orientation. Although size is not critical and can be varied to suit the circumstances of the intended use, a module 23 is typically square with each side having a length L of about 0.8", the module having a thickness T of about 0.5".

As will be described in connection with the circuitry of the system, each display module 23 is electrically connected to a control board which can energize either one of the LEDs in that module. An illumination sequence (e.g., red on, green on, both off) is predetermined and the control board simply cycles through that sequence, changing one step in the cycle each time the control board receives one change signal. The change signals for one module are produced by illuminating the photoresponsive portion of that module's phototransistor using the light pen. Thus, by repeatedly illuminating opening 34 of a specific display module 23 plugged into a certain socket location on panel 10, the LEDs in that module can be caused to go through the illumination sequence and can be left in any one of the states by ending the repeated illuminations. Other illumination sequences can, of course, be selected.

Preferably, the phototransistors are selected to be responsive to only one wavelength, or a narrow band of wavelengths, of light, or filters are placed in openings 34 to achieve the same result, so that the phototransistors are not affected by ambient light.

It is especially important to recognize that when the LEDs in one module are illuminated, the modules in equivalent positions in each other display panel in the system are also illuminated or, more accurately, illumination power is supplied to sockets in the other panels at the locations on those panels equivalent to the one module. Modules 23 can be plugged into the panels in such a way that the module arrangement resembles a map of the rooms, dining tables or parking locations the status of which the modules are to represent. For greatest effectiveness, the modules in each panel are arranged in exactly the same positions on that panel as the modules in each other panel.

Thus, when a table in a restaurant having the system becomes available, the person noting that fact can point the light source at the phototransistor opening 34 in the module representing that table and illuminate the phototransistor one or two times, as necessary, until the green LED in that module is energized, indicating that the table can be given to a patron. The controller board in the panel at that location then communicates the change to the controller boards in the other panels in the system, causing the green LED in the equivalently positioned module in each panel in the restaurant to be illuminated, making the information available to each panel user. Since all panels are the same, information can be put into the system from any panel location and can be read at any panel location.

It will be recognized that any other form of manually actuatable switch can be used in place of the phototransistor. However, the photoresponsive semiconductor is preferred for this purpose because of its low cost, reliability, long life and small size which allows it to be packaged within the rather small module 23. Alternatively, a phototransistor can be placed in the pen and LEDs in the modules. In order to generate an input, the LEDs in the module can be illuminated by "sweeping", i.e., by illumination of the module LEDs in sequence. An output from the pen coinciding with illumination of a specific LED would then identify that LED module as the signal source.

Figure 4:
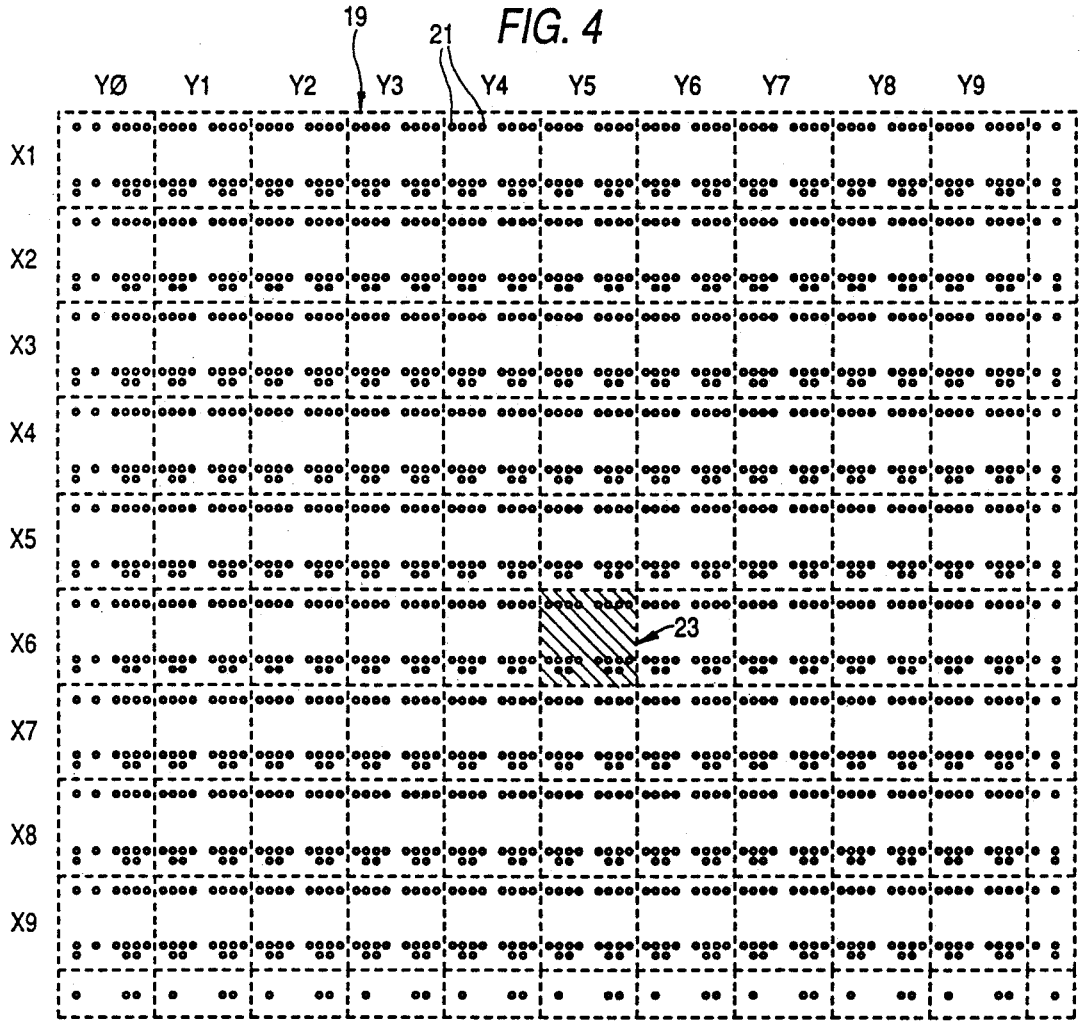
Figure 5A:
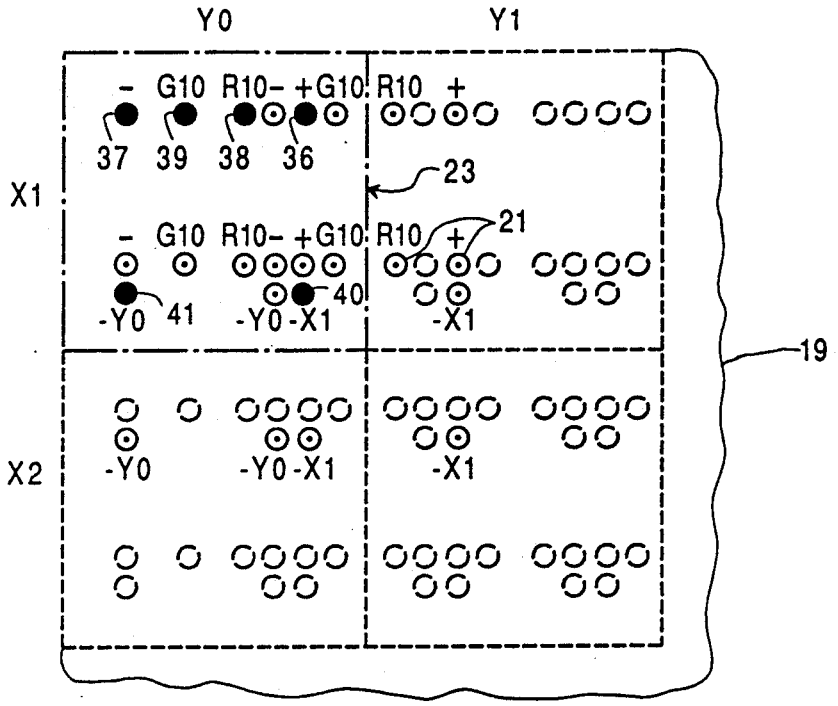
FIGS. 5A–5D are enlarged plan views of one portion of the socket region of FIG. 4 showing, respectively, four possible positions for the module of FIGS. 2 and 3.
Figure 5B:
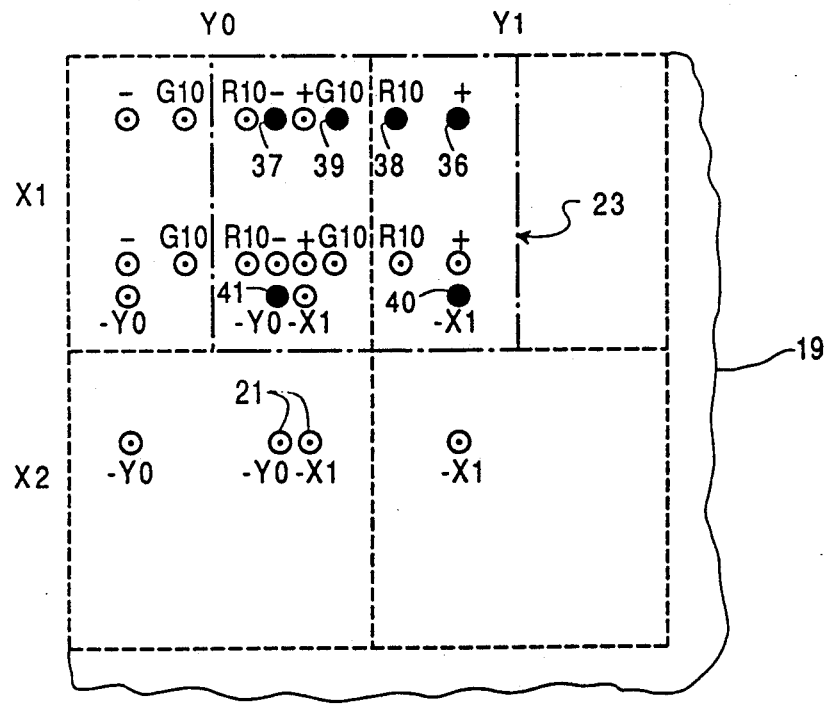
Figure 5C:
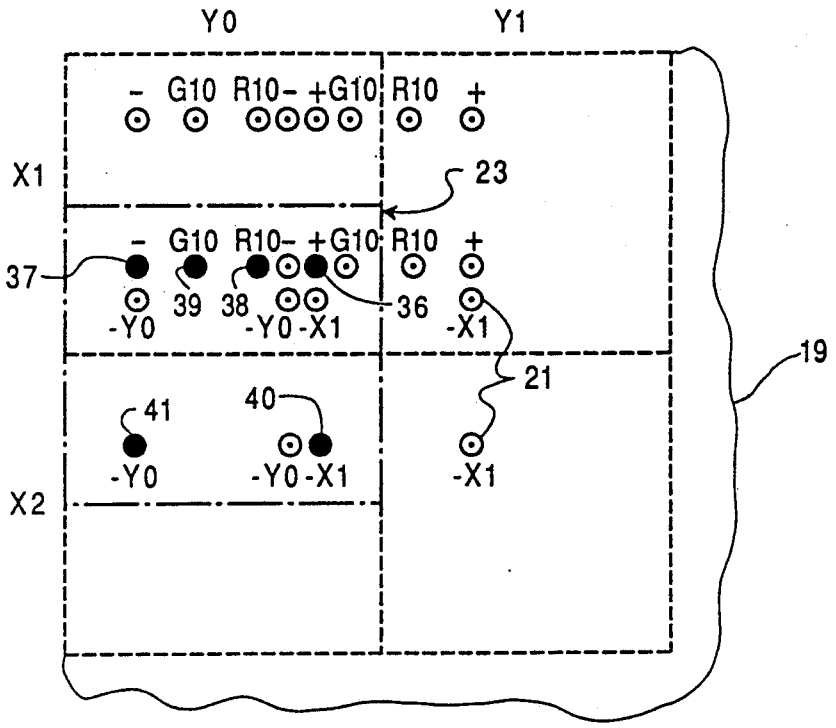
Figure 5D:
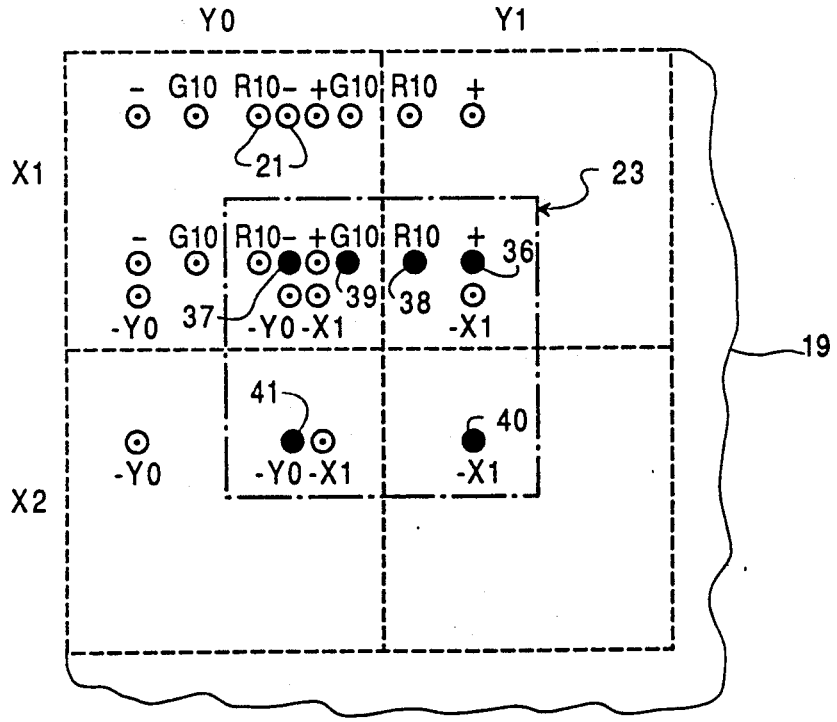

FIG. 4 shows a layout for a typical central region 19 of a display panel having sockets 21 to receive the pins of the plug-in display modules 23. An enlarged view of a portion of region 19 is shown in FIGS. 5A–5D for the specific purpose of illustrating the various positions which can be occupied by a single module 23 in an area of the display panel. The sockets 21 not used in this specific example are shown in dashed lines in FIG. 5A and are omitted from FIGS. 5B, 5C and 5D. Referring again to FIG. 3, it will be noticed that the pins on the module are identified by alphanumeric symbols indicating the functions of those pins, namely +, −, R, G, −X and −Y. In FIGS. 5A–5D it will be noticed that the same symbols appear with the additional notations 1 and 0 indicating that those particular sockets are associated with the 1 row and the 0 column of the display panel socket array. If one inverts the module shown in FIG. 3 to the position in which it could be inserted into the panel, it will be seen that there are sockets to receive the pins of the module in any one of four overlapping locations which are shown, respectively, in FIGS. 5A–5D. There are, for example, four sockets marked −, four sockets marked +, etc. However, once a module has been plugged into any one of those four possible positions, it is not possible to plug another module into the sockets associated with the 1,0 location because the possible module positions physically overlap.

These multiple socket positions allow considerable flexibility in the positions which the modules can occupy on the panel which permits the arrangement of the modules to more closely approximate a map of, for example, the tables in a restaurant which is to be monitored than could be achieved with a simple rectangular socket arrangement with only one possible position per module. The four sockets of each location are wired in parallel so that a module occupying any of the possibilities of location 1,0 will be recognized as occupying that zone without having to be concerned about which location possibility in that zone is actually involved.

Figure 6:
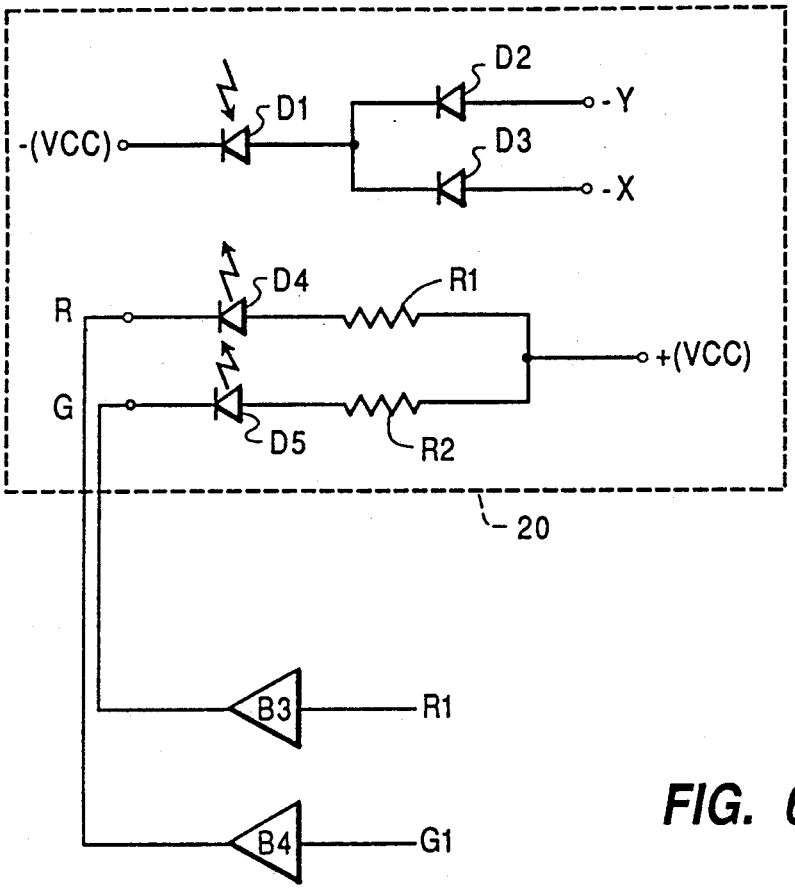
FIG. 6 is a schematic diagram of the internal interconnections of a display module usable in the system of FIGS. 1–5 and buffer drivers associated with the LEDs therein.

As shown in FIG. 6, the six pins on each module are connected within the module to the LED and switch (phototransistor) components therein as follows: the −Y and −X pins are connected to the anodes of signal diodes D2 and D3 respectively. The R and G pins are connected to the cathodes of a red LED D4 and a green LED D5, respectively. The (−) pin is connected to the cathode of a phototransistor D1. The (+) pin supplies power VCC through LED limiting resistors R1 and R2.

Figure 7:
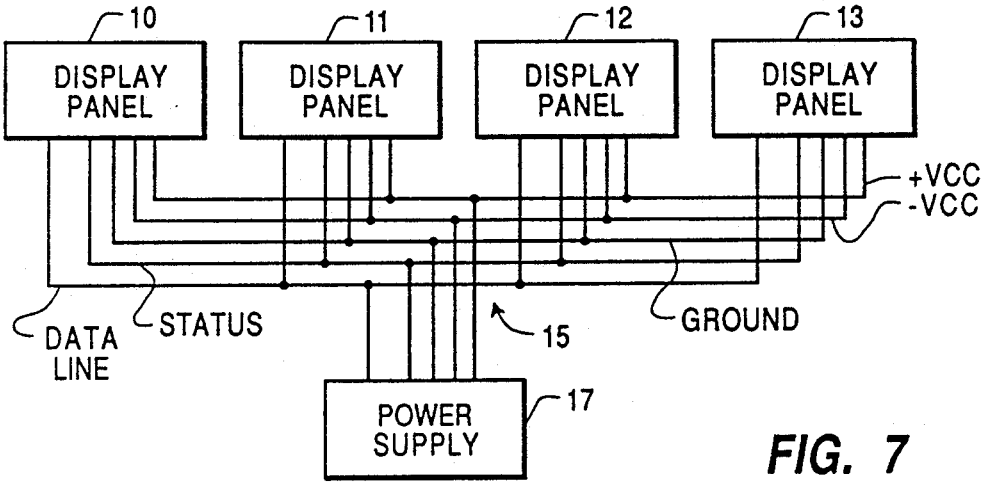
FIG. 7 is a schematic block diagram showing the interconnection of the display panels and the power supply.

FIG. 7 illustrates the electrical connection of the display panels to power supply unit 17 and with each other. The cables 15 are conventional 6 conductor cables with modular plugs and the panels and power supply are provided with modular jacks. All of the cables are connected in parallel at the power supply. Five conductors are used, these being identified in FIG. 7 as data line, status, ground, +VCC and −VCC. The data line and status conductors are used for communication between the panels in the system. The ground, +VCC and −VCC conductors supply power to the panels and, of course, the controller boards therein.

Figure 9:
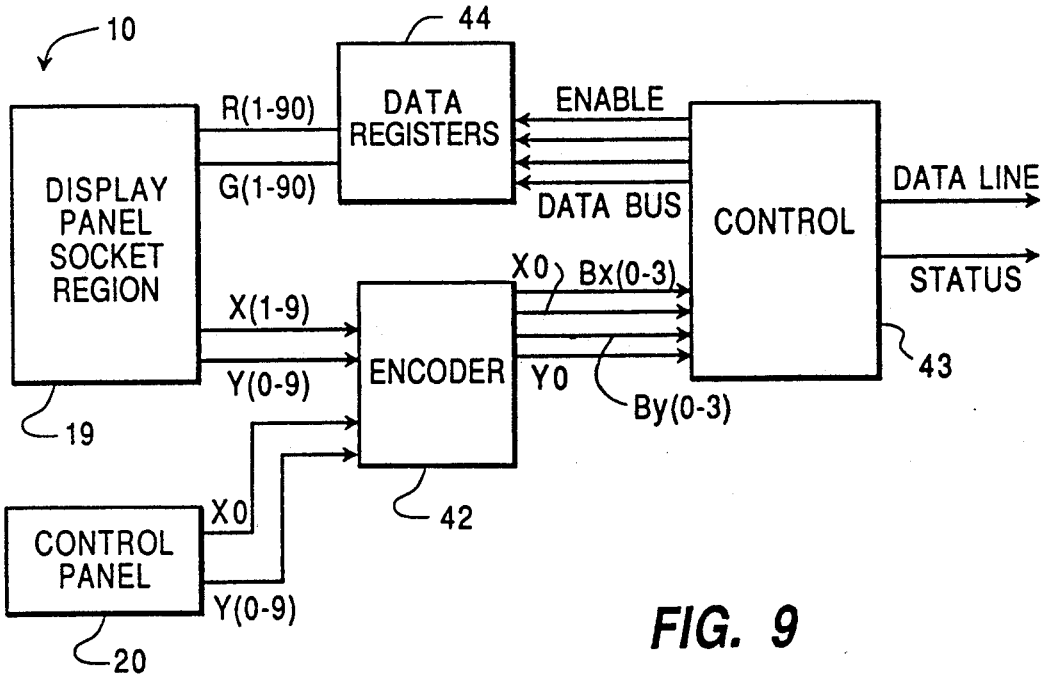
FIG. 9 is a schematic block diagram of a controller board usable in each of the display panels in a system according to the invention.

A controller board is shown in FIG. 9 in a schematic block diagram form. Each controller board is connected to the data line and status conductors of the cable 15 and to the sockets 21 of the socket portion 19 of its associated display panel. When a module 20 is plugged in to any location in the sockets and the system is energized, the module has an X,Y address determined by the physical location of the module, i.e., the column and row location. This can be seen in FIG. 4. A module plugged into location 23, shaded in FIG. 4, has a physical address of X6, Y5.

When the phototransistor switch in a selected module 20 is activated using the light pen 25, one X input and one Y input are generated. That input is delivered to an encoder unit 42 in which it is encoded and delivered to a control section 43 in the form of an 8 bit word describing which module produced the input. If the X or Y input is a zero then X0 or Y0 is sent to the controller as a verification of the zero input.

It should be noted here that X0 is not a part of the matrix area where modules are plugged in. The X0 input is used only for command inputs from the control panel, such as the UPDATE PANNELS command.

The controller accepts the information and toggles the state of a register memory element associated with the selected module in a data register unit 44 so that the new state can be remembered and displayed. The outputs of the register memory elements in the data register unit 44 are delivered to the appropriate sockets on the display panel to energize the red or green LEDs thereon.

Figure 8:
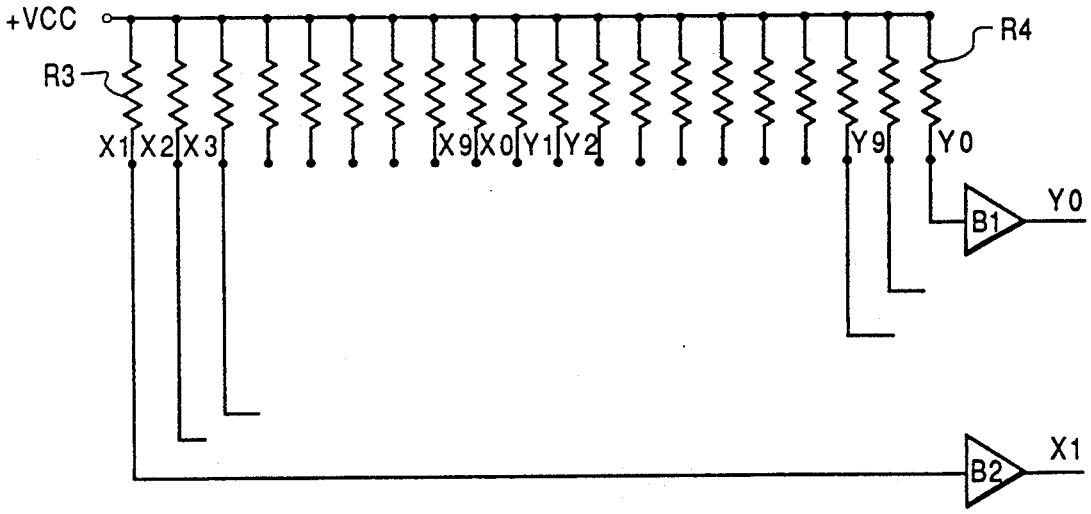
FIG. 8 is a schematic block diagram of a network on the control board connected to module terminals in the display panel socket region of FIGS. 4 and 5.

The above process will now be described in greater detail with reference to FIGS. 6, 7 and 8. The cathodes of diodes D2 and D3 are connected to the anode of phototransistor or photodiode D1, as previously mentioned in connection with FIG. 6, and the cathode of D1 is connected to −VCC. When each "table" module is plugged in it is attached to one "X" net and one "Y" net on the control board as shown in FIG. 8. The module at the X1, Y0 location will be used as an example. The X nets 0 through 9 and the Y nets 0 through 9 are pulled up to VCC on the control board by pullup resistors on the control board as shown in FIG. 8. Each network is connected to the input of a buffer amplifier. Illumination of one diode D1 in one module with an IR light source will activate that diode, i.e., cause that diode to be conductive. With D1 activated, a conducting circuit is created through D2 and D3, pullups for X1 and Y0, in this case. The resulting signal level on the X1 and Y0 nets at input buffers B1 and B2 will be near ground potential. This turns the two buffers on and creates an X, Y input to the encoder 42 in FIG. 9. The entire plug board or panel socket region 19 is wired as an X, Y matrix so every plug position has a unique X, Y address.

Encoder 42 is a binary to binary-coded-decimal (BCD) encoder and generates two 4-bit BCD numbers representing the X, Y address of each input which are delivered to the control unit 43. Control unit 43 evaluates the input to determine which register of data registers 44 to access. The data register unit contains 23 registers, each of which (except one) stores the status of four green LEDs and four red LEDs and is permanently associated with four unique locations in the panel socket region 19. The one exception deals only with two locations. The contents of the selected register are evaluated to determine the present state of the lights and the next light sequence is created and stored back into the register in register unit 44. The outputs of the register bits drive the inputs of LED driver buffers B3 and B4, FIG. 6. The outputs of B3 and B4 are tied to unique red and green LED positions. When the buffer output is at ground potential, a circuit is completed through the selected LED D4 or D5 and that LED is turned on.

Figure 10:
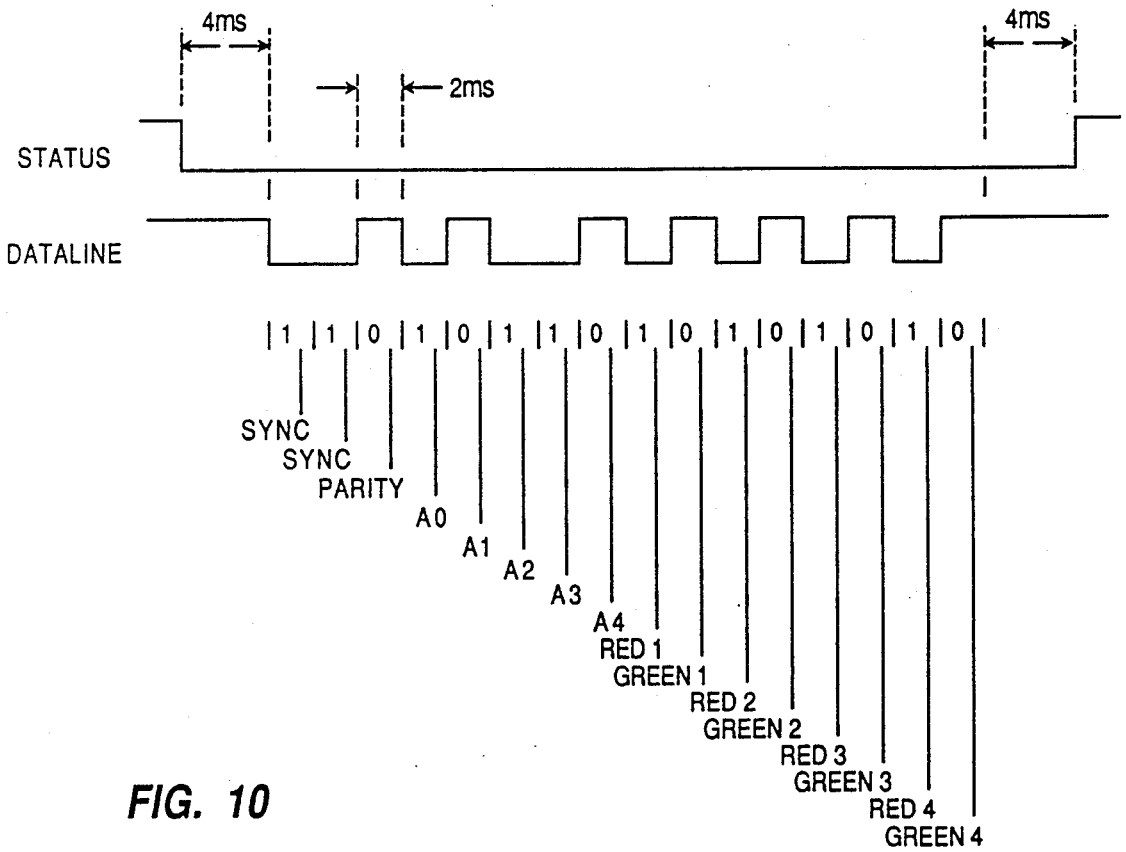
FIG. 10 is a timing diagram illustrating the format of an updating word transmitted from one display panel to the other display panels in a system according to the invention.

The control section then tests the state of the status line to determine if the communication link is busy, a busy state being indicated by a low level on the status line. If the link is busy, the controller must wait until it is available before attempting to transmit the updated data to the other panel units. During this time the controller may also receive a new input from one of the other panels in the system. When the status line goes high, the controller can seize the data line by forcing the status line low. The data is transmitted serially on the data line in a 16 bit word. The format of this word is shown in FIG. 10 wherein it will be seen that the first two bits are sync bits, the third bit is a word parity bit, bits three through 7 are address bits and bits eight through 15 identify indicator status.

A typical data transmission speed for the system is 500 bits per second, although that is not critical. One eight-bit byte of indicator data is transmitted each "send" cycle even though only one indicator may have changed.

The transmitted data is sent to a data register 44 on the controller board and is used in the indicator registers in the transmitting controller and is also received and used to update the indicator registers in all other stations. Each register has a portion which is associated with each socket set location on the panel. When an LED in a specific module 23 is to be illuminated, the register portion associated with that module is cycled to the desired state and remains in that state until a change signal is received or until power is lost. The appropriate are identified by the address information in the transmitted word. At the end of a transmission sequence, the sending panel returns the status line to the high state so that it is available to the other panels.

Figure 11:
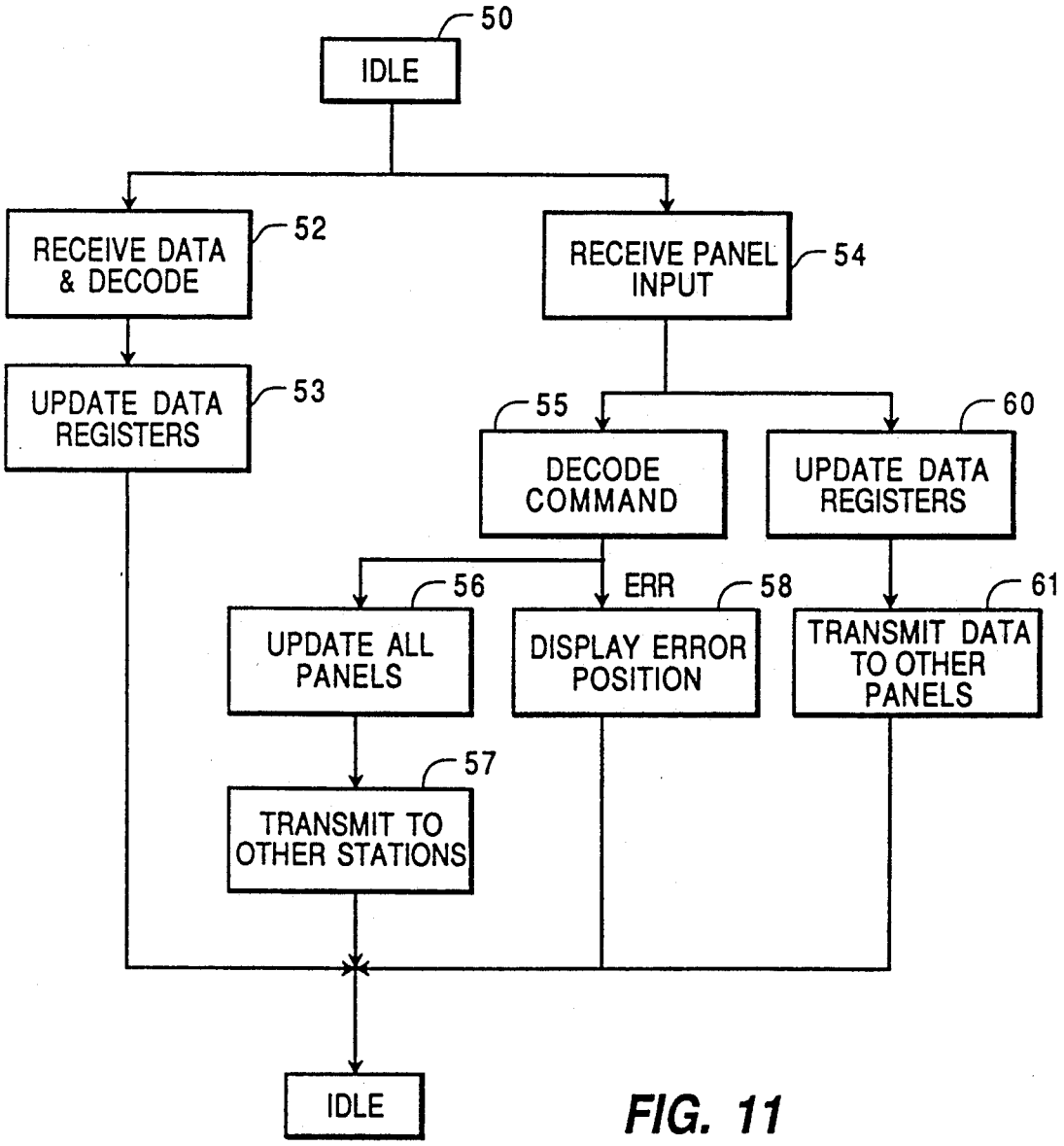
FIG. 11 is a flow diagram of the functions performed by the controller board in a display panel.

FIG. 11 is a diagram of the functions performed in the control section of each panel. All panels are in an idle state (50) until an event initiates an operation. That event can be (a) the activation of a phototransistor in a module plugged in to the panel (a data input), (b) a command input or (c) the status line going from a high to a low state. This last is the start of a receive data sequence. After all received data bits have been received and decoded (52), the new information is used to update the data registers (53). The controller board then returns to the idle state.

If the event is a command input (54), it is received and decoded (55). The input signal of a command input always has a distinctive code associated with it such as the association of an X0. A command can be an "update all panels" command (56) which causes the panel to send all data register information sequentially over the data link to all other panels (57). This command is typically used when a panel which has been off-line is brought on-line and it is necessary to update all registers in the added panel. The command can be issued to any panel which has been on-line by depressing the appropriate command button on the control panel 20.

A "display error" command (58) is a diagnostic command used if there is believed to be some problem with the display such as an LED being kept on. That command causes all indicator lights on the panel issuing the command to go out except for the module position which is stuck in the "on" position. When the command is removed, all lights are returned to the state they were in before the "display error" command was initiated and the controller returns to idle state.

The event can also be a data input from the panel, i.e., the activation of a phototransistor, which will be decoded to see which data register contains the memory for the indicators associated with the phototransistor at that X, Y location. The data register will then be updated (60) and the updating data transmitted to the other panels in the system (61), as described above.

While certain advantageous embodiments have been chosen to illustrate the invention, it will be understood by those skilled in the art that various changes and modifications can be made therein without departing from the scope of the invention as defined in the appended claims.

What is claimed is:

1. An information and display system comprising the combination of a plurality of panels each having a plurality of sockets for receiving display modules, each said socket including a plurality of electrical contact means;

a plurality of display modules for each panel, each said display module including a body, pin means insertable into one of said sockets for supporting said body and making electrical connection with said contact means in said sockets, at least two display lights carried by said body in a position to be visible when said module is supported on said panel, and manually operable electrical switch means carried by said body for producing a change signal;

a control unit operatively associated with each panel, each said control unit including means for receiving change signals from its associated panel and for producing energizing signals for selectively energizing at least one of said display lights in a display module in its associated panel; and circuit means electrically connecting each said control unit to each other control unit in the other panels, whereby each said other control unit produces energizing signals for energizing a light in a display module in each other panel of said plurality of panels.

2. A system according to claim 1 wherein each of said switch means is a phototransistor having an exposed photoresponsive portion, each said phototransistor being operable by directing light from a manually movable light source toward said photoresponsive portion to produce a change signal.

3. A system according to claim 2 wherein said sockets in each of said panels are arranged in a predetermined pattern and said circuit means are arranged to receive and send change signals and energizing signals, respectively, to modules in corresponding locations in each panel.

4. A system according to claim 1 wherein said sockets in each of said panels are arranged in a predetermined pattern and said circuit means are arranged to receive and send change signals and energizing signals, respectively, to modules in corresponding locations in said pattern in each panel.

5. A system according to claim 4 wherein said pin means in each of said modules includes a plurality of pins in a predetermined arrangement and said pattern of sockets includes groups of sockets arranged to receive the pins of one module in any one of a plurality of overlapping locations such that when the pins of a module are plugged into the sockets of one group a second module is physically prevented from being concurrently plugged into the other sockets of that same group.

* * * * *